US007934306B2

(12) United States Patent
Wu

(10) Patent No.: US 7,934,306 B2
(45) Date of Patent: May 3, 2011

(54) METHOD FOR PACKAGING MICRO ELECTROMECHANICAL SYSTEMS MICROPHONE

(75) Inventor: Kuo-Jung Wu, Taipei Hsien (TW)

(73) Assignee: Tong Hsing Electric Industries, Ltd., Taipei (TW)

( * ) Notice: Subject to any disclaimer, the term of this patent is extended or adjusted under 35 U.S.C. 154(b) by 221 days.

(21) Appl. No.: 12/319,742

(22) Filed: Jan. 12, 2009

(65) Prior Publication Data

US 2010/0175242 A1 Jul. 15, 2010

(51) Int. Cl.
*H04R 31/00* (2006.01)

(52) U.S. Cl. ..... 29/594; 29/417; 29/595; 29/609.1; 29/831; 29/846; 73/504.04; 73/504.12; 73/504.15; 73/504.16; 310/330; 310/331; 310/332; 310/340; 310/344

(58) Field of Classification Search ..... 29/417, 29/592.1, 594, 595, 609.1, 831, 846; 73/504.04, 73/504.12–504.16; 310/330–332, 340, 344, 310/345

See application file for complete search history.

(56) References Cited

U.S. PATENT DOCUMENTS 4,830,623 A * 5/1989 Owens et al. ..... 439/71
5,267,867 A * 12/1993 Agahdel et al. ..... 439/73
5,414,917 A * 5/1995 Tanaka ..... 29/25.35

* cited by examiner

*Primary Examiner* — Paul D Kim
(74) *Attorney, Agent, or Firm* — William E. Pelton, Esq.; Cooper & Dunham LLP

(57) ABSTRACT

A method for packaging micro electromechanical systems (MEMS) microphone has steps of providing a base, arranging and mounting multiple microphone component assemblies on the base, providing a frame, mounting the frame on the base, forming multiple microphone units, providing a cover; mounting the microphone units on the cover and forming multiple MEMS microphones. Therefore, the MEMS microphones can be produced once in large quantities to save production time and costs.

12 Claims, 12 Drawing Sheets

METHOD FOR PACKAGING MICRO ELECTROMECHANICAL SYSTEMS MICROPHONE

BACKGROUND OF THE INVENTION

1. Field of the Invention

The present invention relates to a method, and more particularly to a method for packaging micro electromechanical systems (MEMS) microphone to produce MEMS microphones in large quantities.

2. Description of Related Art

The advancement of the electronic technology has resulted in most electronic devices being lighter, thinner, shorter and smaller. Micro electromechanical system (MEMS) is commonly used because productions manufactured by MEMS technique are in micrometer size.

For example, MEMS microphones have gradually replaced conventional electric condenser microphones (ECMs). The ECMs have low heat resistance so the ECMs cannot be manufactured with surface mount technology (SMT) and ECMs are difficult to be manufactured. Contrariously, the MEMS microphones have high heat resistance. The MEMS microphones can be manufactured with SMT to simplify the manufacture process of the MEMS microphones.

However, conventional method for manufacturing the MEMS microphone only packages one MEMS microphone each time. The conventional method takes a lot of time on packaging the MEMS microphones.

To overcome the shortcomings, the present invention provides a method for packaging MEMS microphone to mitigate or obviate the aforementioned problems.

SUMMARY OF THE INVENTION

The main objective of the invention is to provide a method for packaging micro electromechanical systems (MEMS) microphone to produce MEMS microphones in large quantities.

The method in accordance with the present invention comprises steps of providing a base, arranging and mounting multiple microphone component assemblies on the base, providing a frame, mounting the frame on the base, forming multiple microphone units, providing a cover, mounting the microphone units on the cover and forming multiple MEMS microphones. Therefore, multiple MEMS microphones can be once packaged to save production time and costs.

Other objectives, advantages and novel features of the invention will become more apparent from the following detailed description when taken in conjunction with the accompanying drawings.

DETAILED DESCRIPTION OF PREFERRED EMBODIMENT

Figure 1:
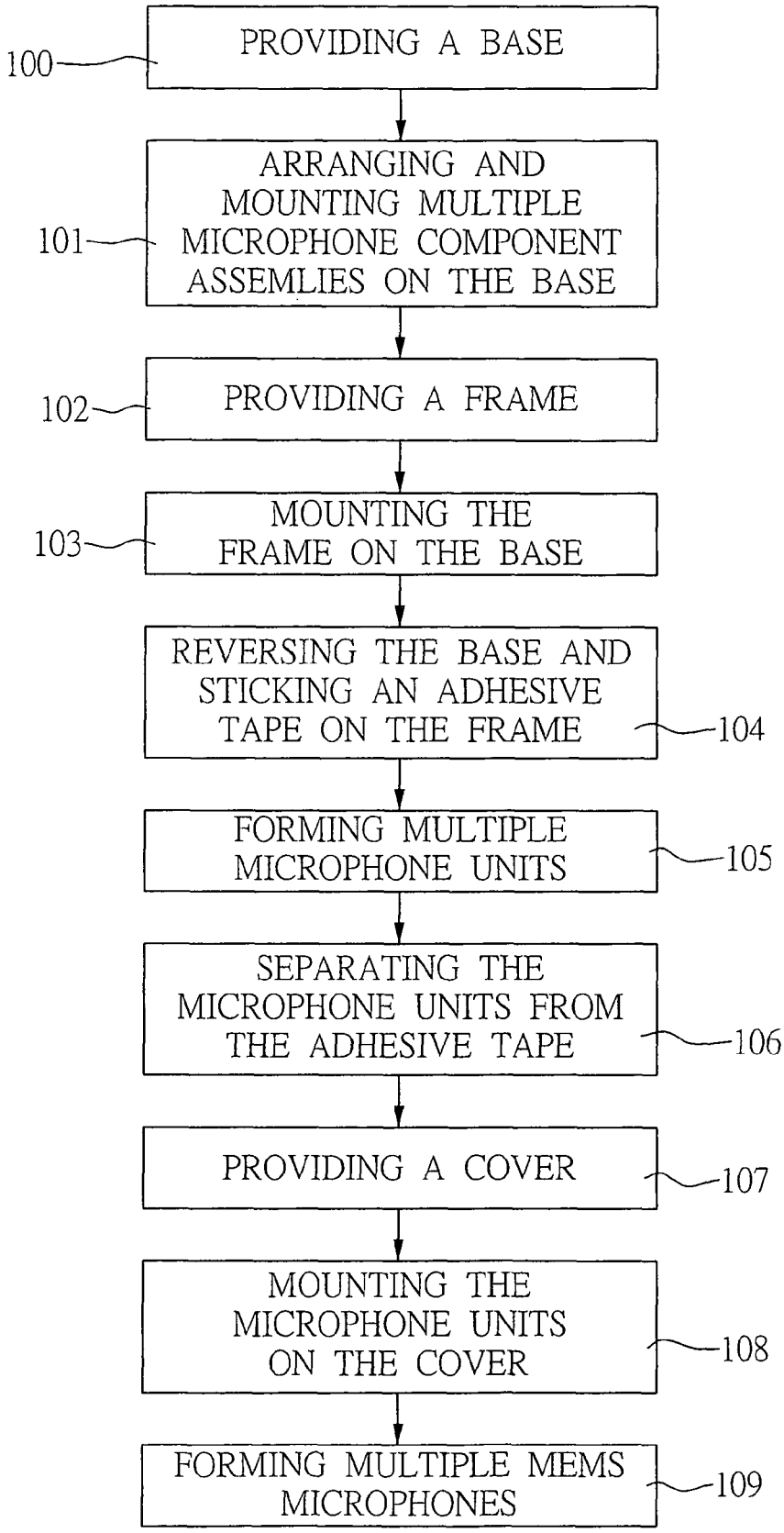
FIG. 1 is a flow chart of a method in accordance with the present invention.

With reference to FIG. 1, a method for packaging micro electromechanical systems (MEMS) microphone in accordance with the present invention comprises steps of providing a base (100), arranging and mounting multiple microphone component assemblies on the base (101), providing a frame (102), mounting the frame on the base (103), optionally reversing the base and adhering a adhesive tape to the frame (104), forming multiple microphone units (105), optionally separating the microphone units from the adhesive tape (106), providing a cover (107), mounting the microphone units on the cover (108) and forming multiple MEMS microphones (109).

Figure 2A:
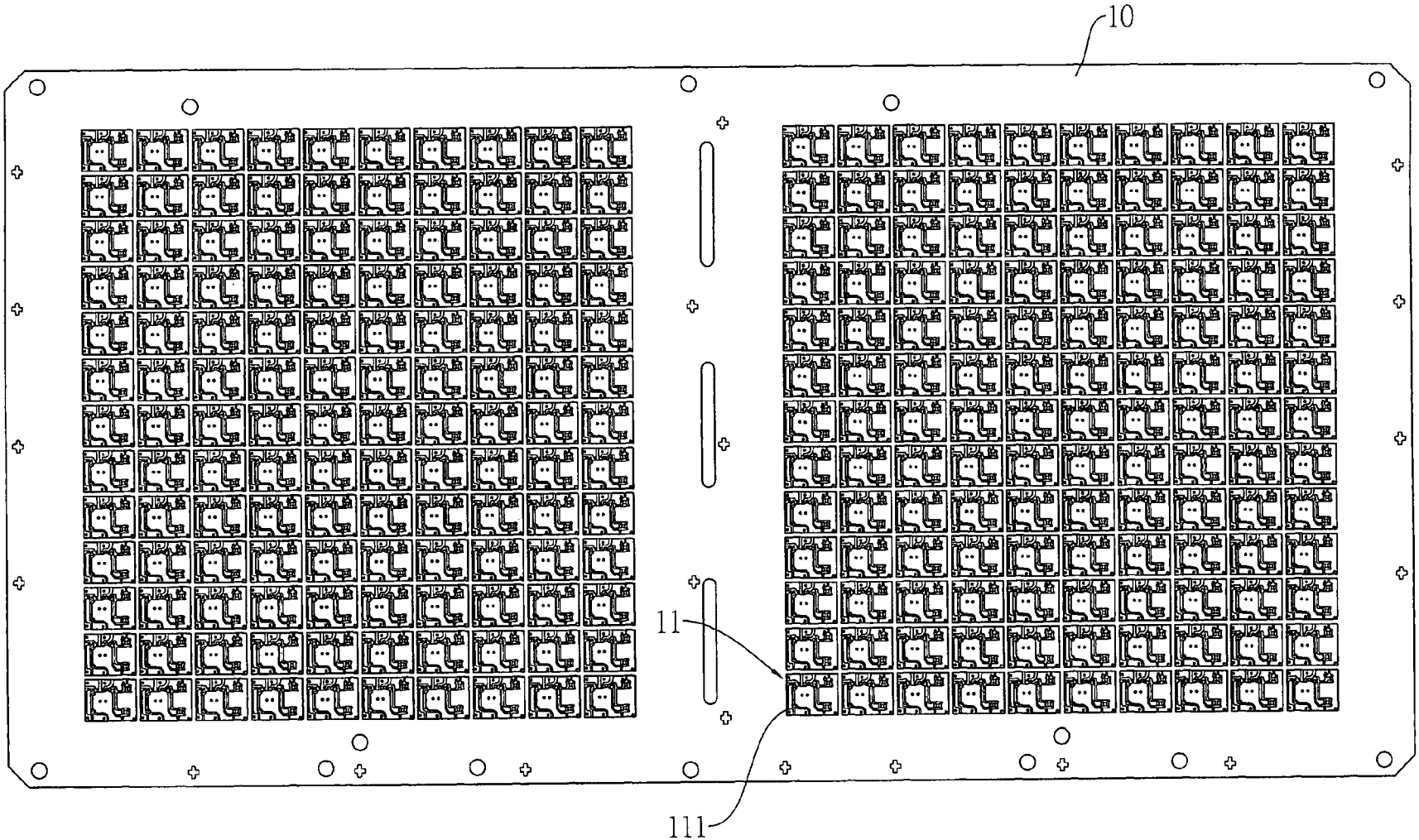
FIG. 2A is a top view of a base in a step of arranging and mounting multiple microphone component assemblies on the base.
Figure 2B:
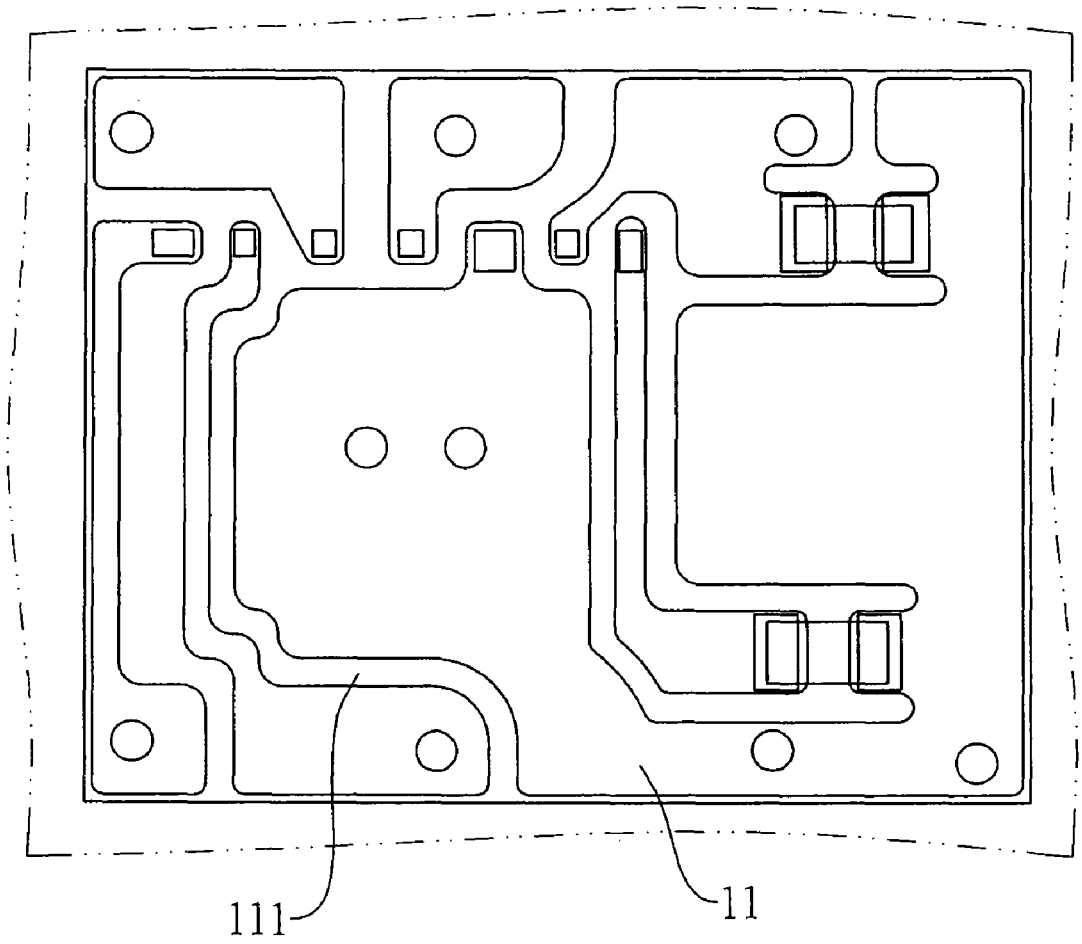
FIG. 2B is a top view of a circuit block on the base in FIG. 2A.
Figure 3:
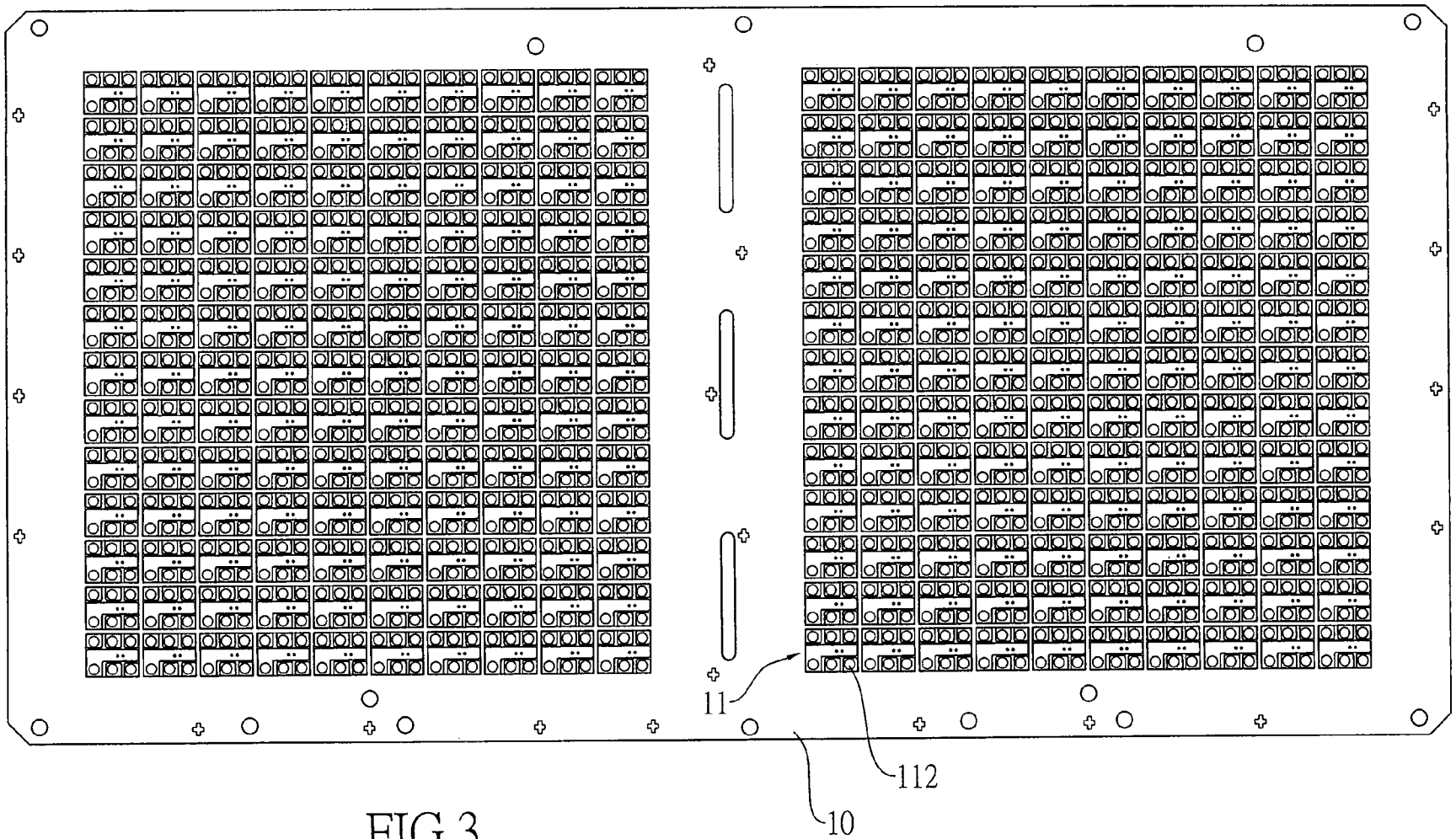
FIG. 3 is a bottom view of the base in FIG. 2.

With further reference to FIGS. 2A, 2B and 3, in the step of providing a base (100), the base (10) has a top, a bottom, multiple circuit blocks (11), multiple circuit assemblies (111) and multiple contact assemblies (112). The circuit blocks (11) are defined on the base (10) and may be arranged in matrix. The circuit assemblies (111) are formed on the top of the base (10) and respectively in the circuit blocks (11). The contact assemblies (112) are formed on the bottom of the base (10) and respectively in the circuit blocks (11), and each contact assembly (112) connects to the circuit assembly (111) in the same circuit block (11) and comprises multiple contacts. Each contact assembly (112) is used to electrically connect to an external circuit board.

Figure 4A:
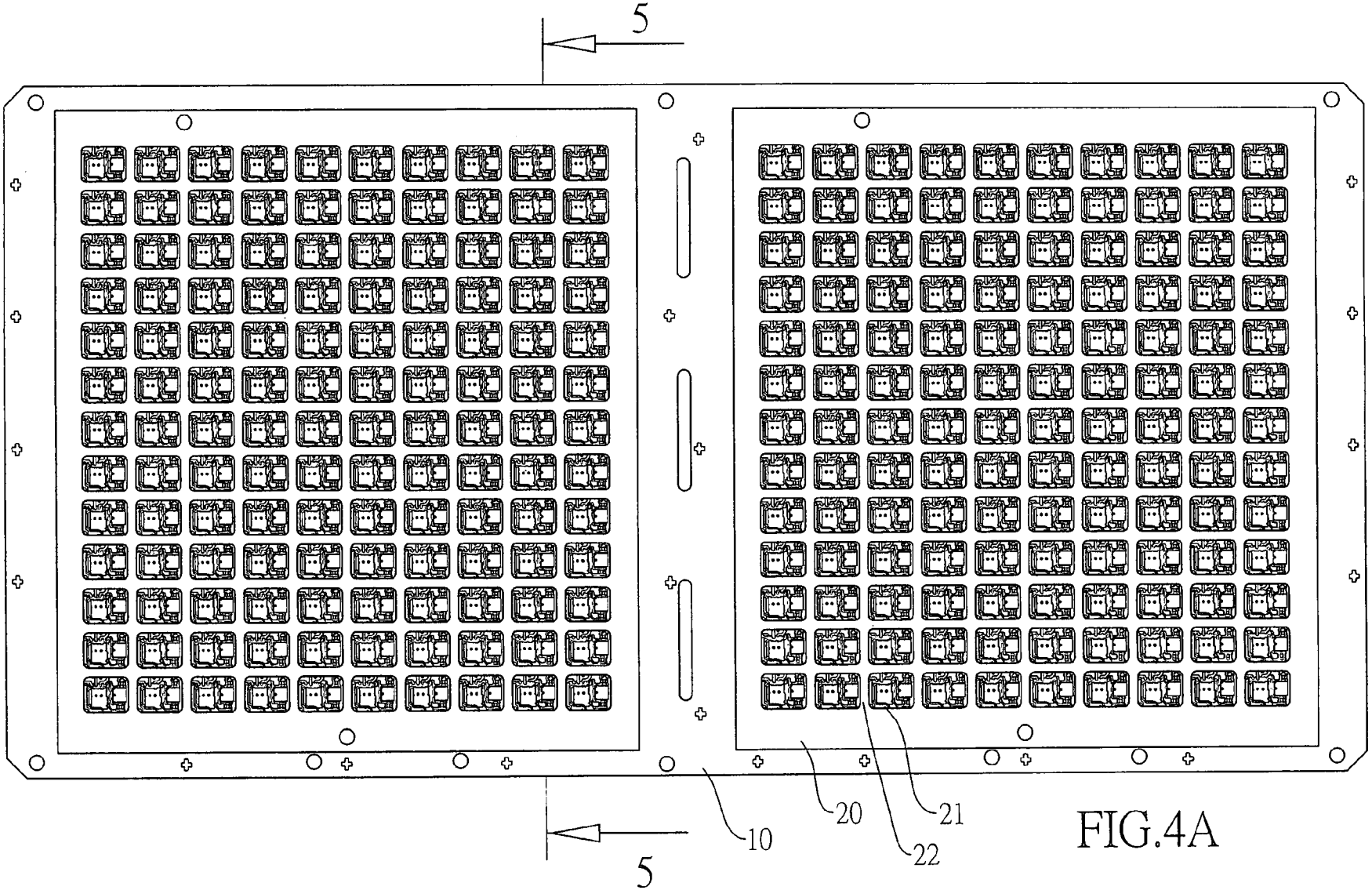
FIG. 4A is a top view of the base with a frame in a step of mounting the frame on the base.
Figure 4B:
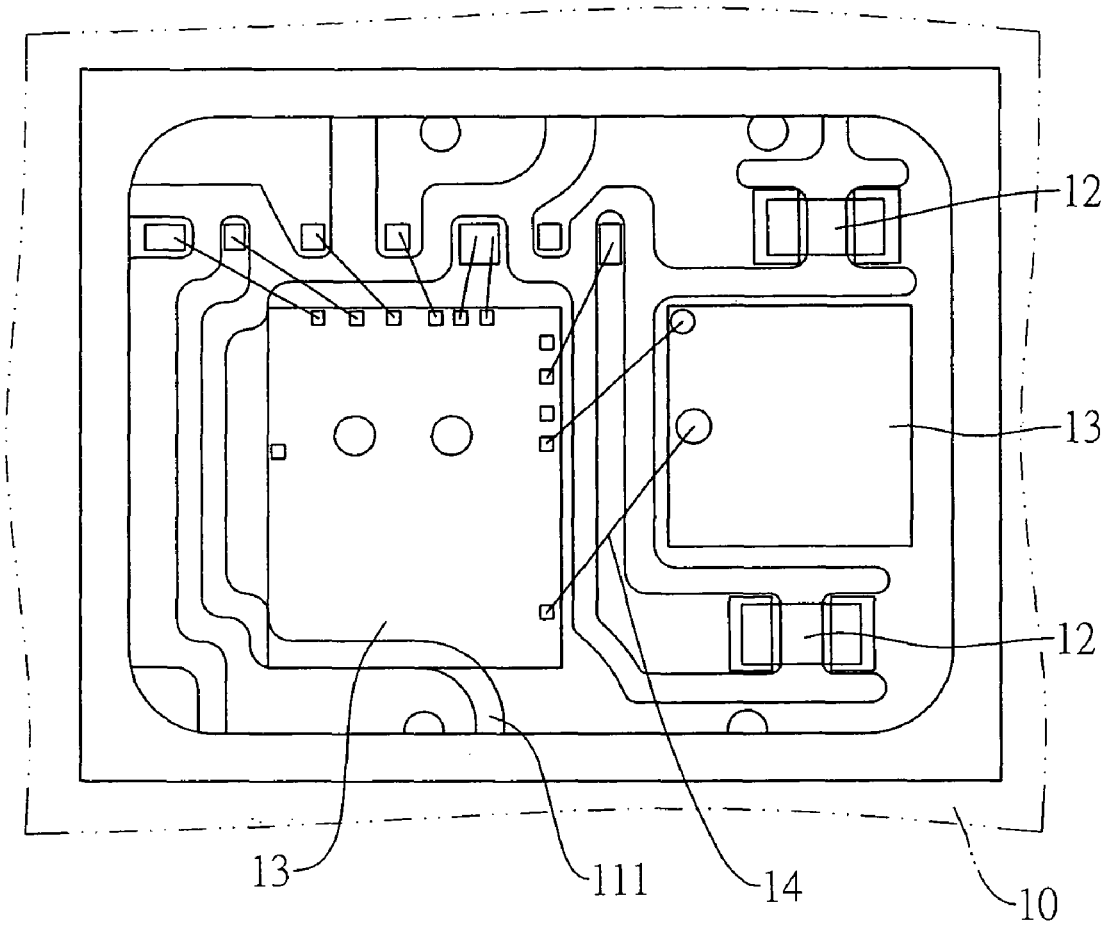
FIG. 4B is a top view of circuit block on the base with microphone component assembly in FIG. 4A.

With further reference to FIGS. 4A and 4B, in the step of arranging and mounting multiple microphone component assemblies on the base (10), the microphone component assemblies are mounted respectively in the circuit blocks (11), and each microphone component assembly may comprise multiple passive components (12) and multiple chips (13). The passive components (12) in one microphone component assembly may be mounted on the top of the base (10) with surface mount technology (SMT) to electrically connect to the circuit assembly (111) in the same circuit block (11). The chips (13) in one microphone component assembly may be application-specific integrated circuit (ASIC) integrated circuit (IC) or MEMS IC and may be mounted on the top of the base (10) with die bond technique. Additionally, the chips (13) in one microphone component assembly electrically connect to the circuit assembly (111) in the same circuit block (11) over bonding wires (14).

In the step of providing a frame (102), the frame (20) comprises multiple frame holes (21) and multiple ribs (22). The frame holes (21) correspond respectively to the circuit blocks (11) on the base (10). The ribs (22) are between the frame holes (21).

In the step of mounting the frame on the base (103), the frame (20) is mounted on the top of the base (10), and the frame holes (21) respectively surround and expose the microphone component assemblies.

Figure 5:
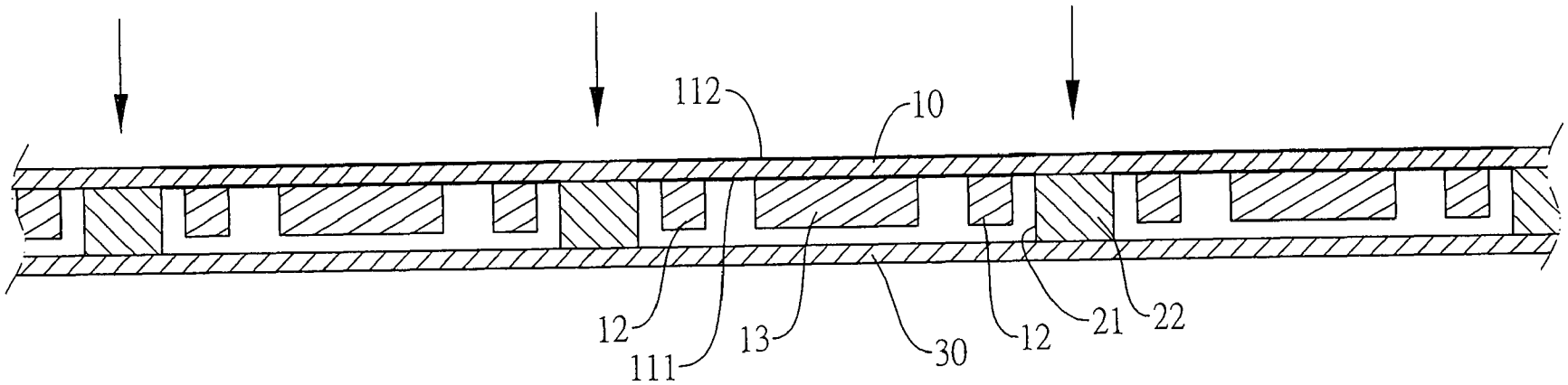
FIG. 5 is a side view in cross section of the base, the frame and an adhesive tape in a step of reversing the base and adhering an adhesive tape to the frame.

With further reference to FIG. 5, in the step of reversing the base and adhering a adhesive tape to the frame (104), the base (10) is turned upside-down by 180 degrees to let the microphone component assemblies face downward. An adhesive tape (30) is adhered to the frame (20).

Figure 6:
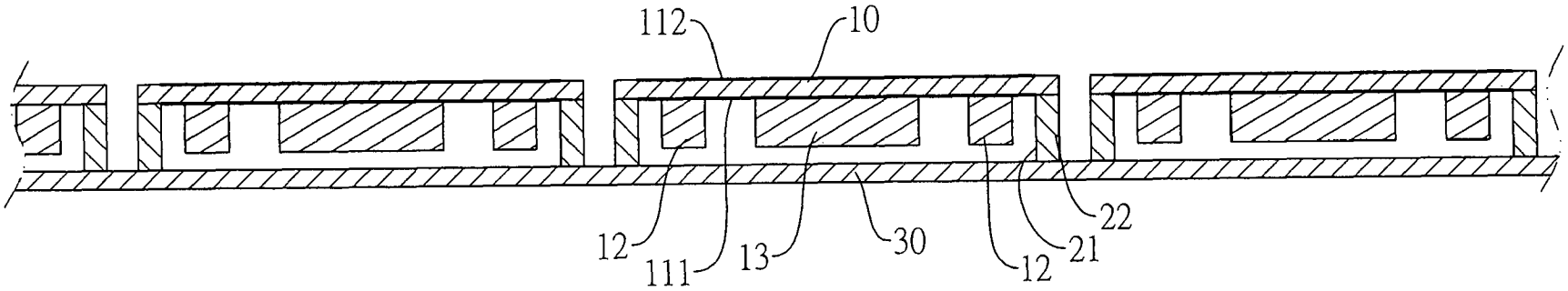
FIG. 6 is a side view in cross section of the base, the frame and the adhesive tape in a step of forming multiple microphone units.

With further reference to FIGS. 5 and 6, in the step of forming multiple microphone units (105), the base (10) and the frame (20) are cut along the ribs (22) to be divided into multiple microphone units. Because the adhesive tape (30) is adhered to the frame (20), the microphone units are still attached on the adhesive tape (30) to avoid missing the microphone units.

Figure 7:
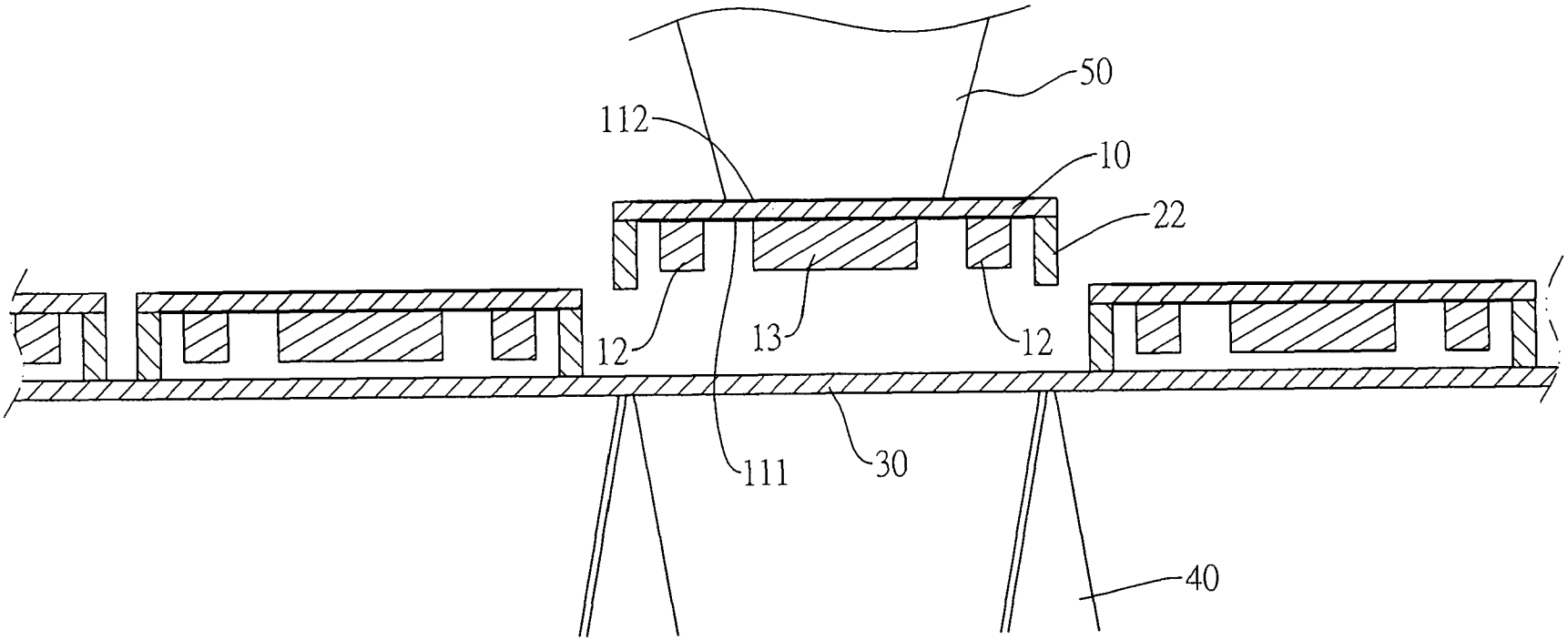
FIG. 7 is a side view in cross section of the base, the frame and the adhesive tape in a step of separating the microphone units from the adhesive tape.
Figure 8:
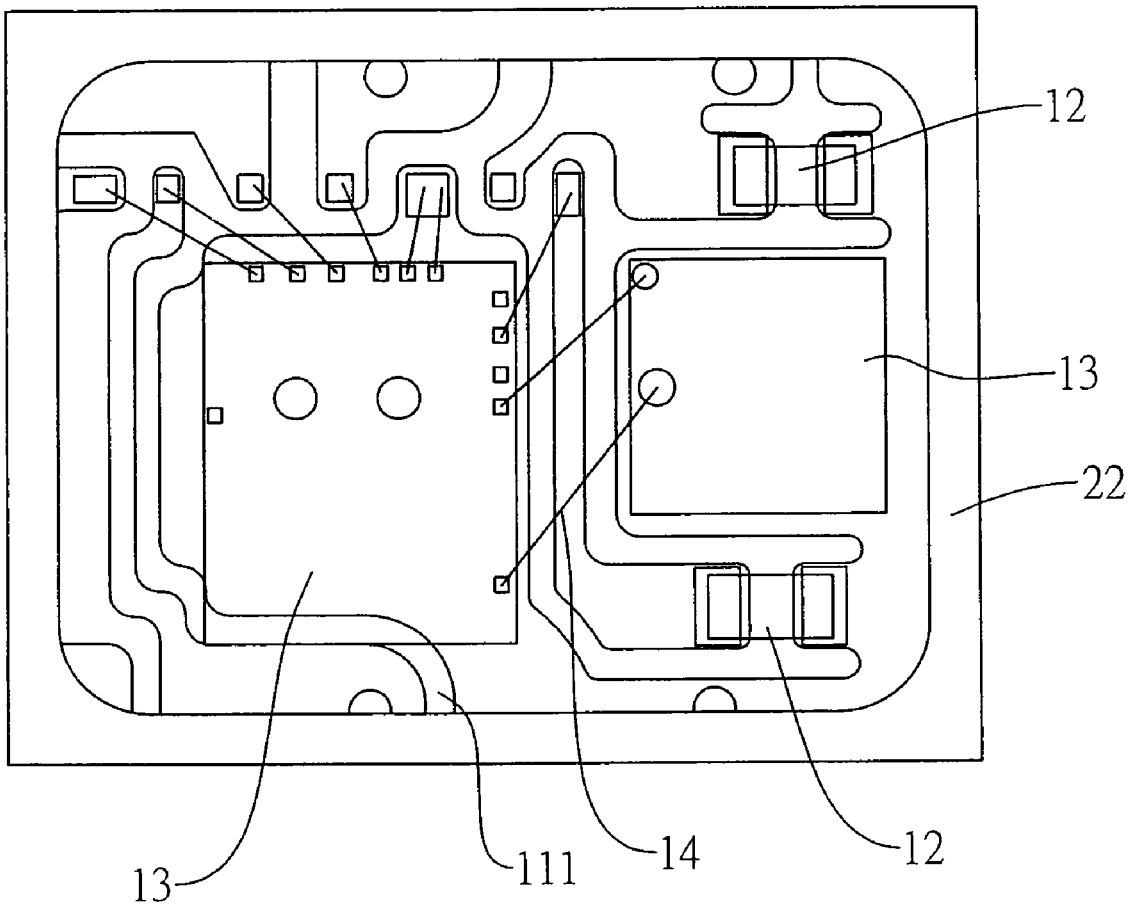
FIG. 8 is a bottom view of a microphone unit finished by the step of separating the microphone units from the adhesive tape.
Figure 9:
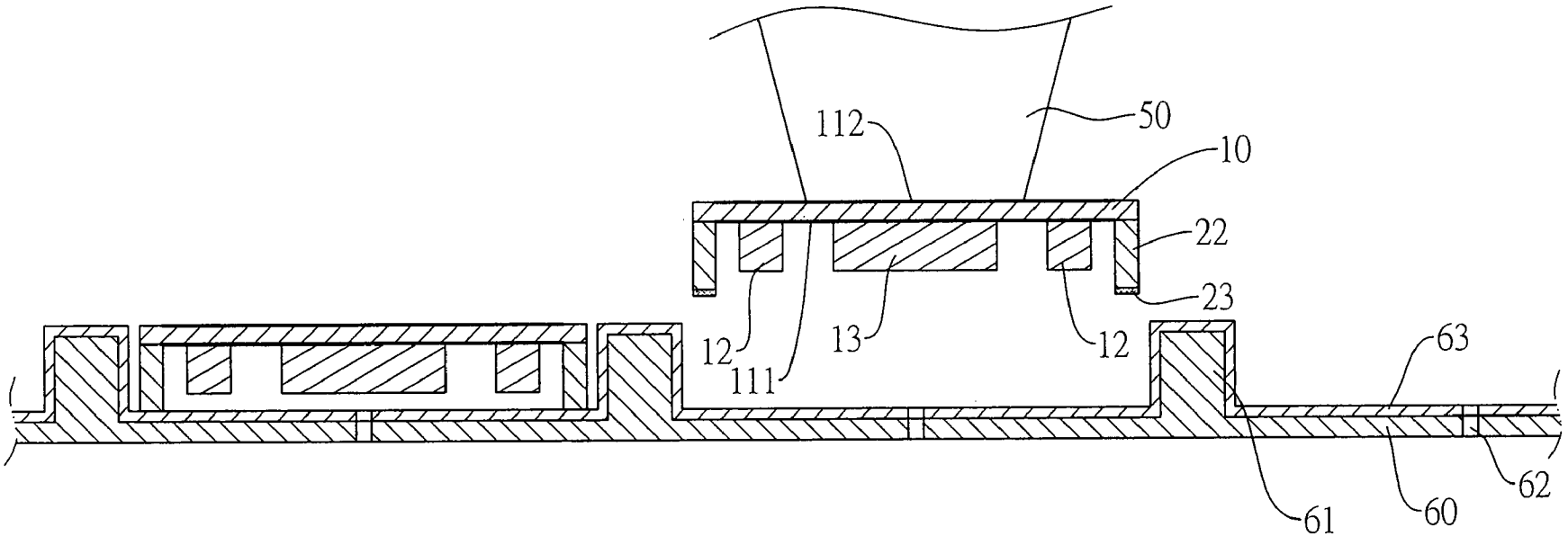
FIG. 9 is a side view in cross section of the base, the frame and a cover in a step of mounting the microphone units on the cover.

With further reference to FIGS. 7 and 8, in the step of separating the microphone units from the adhesive tape (106), each microphone unit is separated from the adhesive tape (30) by using an ejector (40) to push the microphone unit over the adhesive tape (30) and a suck nozzle (50) to pull the microphone unit away from the adhesive tape (30). With further reference to FIG. 9, additionally, the separated microphone unit has glue (23) attached thereon.

In the step of providing a cover (107), the cover (60) has a top, multiple annular walls (61) and multiple sound holes (62). The annular walls (61) protrude from the top of the cover (60). The sound holes (62) formed through the cover (60) and are surrounded respectively by the annular walls (61). Moreover, the cover (60) may further have an electroplate layer (63). The electroplate layer (63) caps the top of the cover (60) and the annular walls (61).

In the step of mounting the microphone units on the cover (108), the microphone units are one-on-one mounted in the annular walls (61) and adhered on the electroplate layer (63) in the annular walls (61) with the glue (23).

Figure 10:
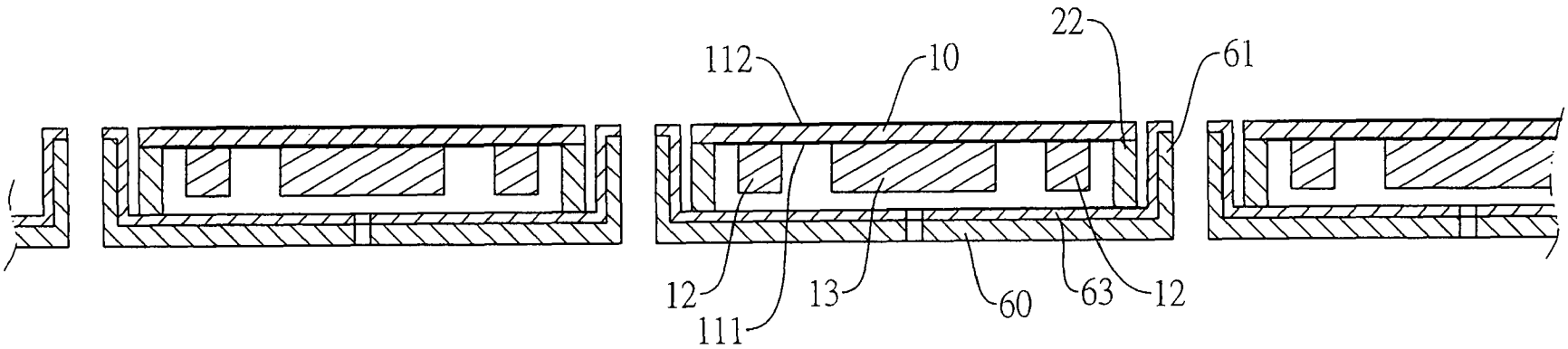
FIG. 10 is a side view in cross section of multiple MEMS microphones finished by a step of forming multiple MEMS microphones.

With further reference to FIG. 10, in the step of forming multiple MEMS microphones (109), the cover (60) and the base (10) are cut along the annular walls (61) to form multiple package-finished MEMS microphones. Each MEMS microphone can be soldered on and electrically connected to the external circuit board with the contacts (112) and the electroplate layer (63) on the annular walls (61). If the electroplate layer (63) is electrically connected to ground, the electroplate layer (63) in the annular walls (61) will become an electromagnetic interfering (EMI) shield.

The above-mentioned method once finishes packaging multiple MEMS microphones. Therefore, production speed and quantity can be effectively improved.

Even though numerous characteristics and advantages of the present invention have been set forth in the foregoing description, together with details of the structure and function of the invention, the disclosure is illustrative only. Changes may be made in detail, especially in matters of arrangement of parts within the principles of the invention to the full extent indicated by the broad general meaning of the terms in which the appended claims are expressed.

What is claimed is:

1. A method for packaging micro electromechanical systems (MEMS) microphone comprising steps of:

providing a base having a top;

a bottom;

multiple circuit blocks being defined on the base;

multiple circuit assemblies being formed on the top of the base and respectively in the circuit blocks; and multiple contact assemblies being formed on the bottom of the base and respectively in the circuit blocks, and each contact assembly connecting to the circuit assembly in the same circuit block;

arranging and mounting multiple microphone component assemblies respectively in the circuit blocks of the base;

providing a frame comprising multiple frame holes corresponding respectively to the circuit blocks on the base; and multiple ribs being between the frame holes;

mounting the frame on the base, and the frame holes respectively surrounding and exposing the microphone component assemblies;

forming multiple microphone units by cutting the base and the frame along the ribs;

providing a cover having a top;

multiple annular walls protruding from the top of the cover; and multiple sound holes being formed through the cover and being surrounded respectively by the annular walls;

mounting the microphone units on the cover and one-on-one mounted in the annular walls; and forming multiple MEMS microphones by cutting the cover and the base along the annular walls.

2. The method as claimed in claim 1 further comprising steps of:

reversing the base and adhering an adhesive tape to the frame to turn the microphone component assemblies facing downward and adhere the adhesive tape to the frame after the step of mounting the frame on the base; and separating the microphone units from the adhesive tape by using an ejector to push the microphone unit over the adhesive tape and a suck nozzle to pull the microphone unit away from the adhesive tape after the step of forming multiple microphone units, and subsequently attaching a glue to the separated microphone unit.

3. The method as claimed in claim 2, wherein the cover further has an electroplate layer capping the top of the cover and the annular walls.

4. The method as claimed in claim 2, wherein each microphone component assembly further comprises multiple passive components being mounted on the base with SMT to electrically connect to the circuit assembly in the same circuit block.

5. The method as claimed in claim 2, wherein each microphone component assembly further comprises multiple chips being mounted on the base with die bond technique.

6. The method as claimed in claim 5, wherein the chips in one microphone component assembly electrically connect to the circuit assembly in the same circuit block over bonding wires.

7. The method as claimed in claim 2, wherein the circuit blocks are arranged in matrix.

8. The method as claimed in claim 1, wherein the cover further has an electroplate layer capping the top of the cover and the annular walls.

9. The method as claimed in claim 1, wherein each microphone component assembly further comprises multiple passive components being mounted on the base with surface mount technology (SMT) to electrically connect to the circuit assembly in the same circuit block.

10. The method as claimed in claim 1, wherein each microphone component assembly further comprises multiple chips being mounted on the base with die bond technique.

11. The method as claimed in claim 10, wherein the chips in one microphone component assembly electrically connect to the circuit assembly in the same circuit block over bonding wires.

12. The method as claimed in claim 1, wherein the circuit blocks are arranged in matrix.

* * * * *